US007476886B2

(12) United States Patent
Bykanov et al.

(10) Patent No.: US 7,476,886 B2
(45) Date of Patent: Jan. 13, 2009

(54) SOURCE MATERIAL COLLECTION UNIT FOR A LASER PRODUCED PLASMA EUV LIGHT SOURCE

(75) Inventors: Alexander N. Bykanov, San Diego, CA (US); Bjorn Hansson, Bromma (SE)

(73) Assignee: Cymer, Inc., San Diego, CA (US)

( * ) Notice: Subject to any disclaimer, the term of this patent is extended or adjusted under 35 U.S.C. 154(b) by 194 days.

(21) Appl. No.: 11/509,925

(22) Filed: Aug. 25, 2006

(65) Prior Publication Data

US 2008/0048133 A1 Feb. 28, 2008

(51) Int. Cl.
*H01J 35/20* (2006.01)

(52) U.S. Cl. ..... 250/504 R; 250/493.1; 378/119

(58) Field of Classification Search ..... 250/504 R, 250/493.1; 378/119, 143
See application file for complete search history.

(56) References Cited

U.S. PATENT DOCUMENTS 5,991,360 A * 11/1999 Matsui et al. ..... 378/119
6,549,551 B2 4/2003 Ness et al. ..... 372/38.07
6,567,450 B2 5/2003 Myers et al. ..... 372/55
6,625,191 B2 9/2003 Knowles et al. ..... 372/55
2004/0129896 A1 * 7/2004 Schmidt et al. ..... 250/492.2
2004/0208286 A1 10/2004 Richardson ..... 378/119
2006/0249699 A1 11/2006 Bowering et al. ..... 350/504
2007/0001131 A1 1/2007 Ershov et al. ..... 250/503.1

* cited by examiner

*Primary Examiner*—Kiet T Nguyen
(74) *Attorney, Agent, or Firm*—Matthew K. Hillman

(57) ABSTRACT

An EUV light source is disclosed which may comprise a laser source generating a laser beam and a source material, e.g. tin, $SnBr_4$, $SnBr_2$, $SnH_4$, tin-gallium alloys, tin-indium alloys, tin-indium-gallium alloys or combinations thereof, that is irradiated by the laser beam to form a plasma and emit EUV light. The EUV light source may also comprise a beam dump positioned to receive the laser beam and a system controlling the temperature of the beam dump within a pre-selected range. In one embodiment, the source material may be irradiated at an irradiation zone and the source may further comprises a receiving structure formed with a surface shaped to receive source material ejected from the irradiation zone and direct the received source material for subsequent collection. The receiving structure and the beam dump may be formed as a single integrated unit.

26 Claims, 3 Drawing Sheets

SOURCE MATERIAL COLLECTION UNIT FOR A LASER PRODUCED PLASMA EUV LIGHT SOURCE

CROSS-REFERENCE TO RELATED APPLICATIONS

The present application is related to co-pending U.S. patent application Ser. No. 11/406,216 entitled ALTERNATIVE FUELS FOR EUV LIGHT SOURCE, filed on Apr. 17, 2006, U.S. patent application Ser. No. 11/174,299 entitled LPP EUV LIGHT SOURCE DRIVE LASER SYSTEM, filed on Jun. 29, 2005, and U.S. Pat. Nos. 6,625,191, 6,549,551 and 6,567,450, the disclosures of each of which are hereby incorporated by reference herein.

FIELD

The present application relates to extreme ultraviolet ("EUV") light sources providing EUV light from a plasma created from a source material and collected and directed to a focus for utilization outside of the EUV light source chamber, e.g., for semiconductor integrated circuit manufacturing photolithography e.g., at wavelengths of around 50 nm and below.

BACKGROUND

EUV light, e.g., electromagnetic radiation having wavelengths of around 50 nm or less (also sometimes referred to as soft x-rays), and including light at a wavelength of about 13.5 nm, can be used in photolithography processes to produce extremely small features in substrates, e.g., silicon wafers.

Methods to produce EUV light include, but are not necessarily limited to, converting a material into a plasma state that has an element, e.g., xenon, lithium or tin, indium, antimony, tellurium, aluminum, etc., with an emission line in the EUV spectrum. In one such method, often termed laser produced plasma ("LPP") the required plasma can be produced by irradiating a target material, such as a droplet, stream or cluster of material having the required line-emitting element, with a laser beam.

Heretofore, various systems in which a line-emitting element is presented for irradiation/electric discharge have been disclosed. Many diverse forms and states have been attempted, to include, presenting the element in pure form, e.g., pure metal, presenting the element as a compound, e.g., a salt, or in a solution, e.g., dissolved in a solvent such as water. Moreover, systems have been disclosed in which the line-emitting substance is presented as a liquid, including relatively volatile liquids, a gas, a vapor and/or a solid, and can be in the form of a droplet, stream, moving tape, aerosol, particles in a liquid stream, gas jet, etc.

One factor that is often considered when designing a high volume EUV light source is the generation and mitigation of debris inside the light source which may adversely affect the light source. For example, the debris may damage EUV light source optics, e.g., the laser input window, collector mirror and/or metrology equipment, may absorb/interfere with the transmission of EUV light within the light source, and/or may cause damage to downstream components such as the components of the illuminator/projection optics used to expose a semiconductor. These debris can include out-of-band photons, high energy ions and scattered debris from the plasma formation, e.g., atoms and/or clumps/microdroplets of source material, and for volatile source materials can include gasses and/or vapors. Typically, these debris are emitted in all directions from the irradiation site, however, in some cases, a significant portion of the irradiated source material may be directed in the same general direction as the laser beam after irradiation. In the case of a volatile source material, the source material may continue to produce gas/vapor after passing through the irradiation site. Moreover, precautions may be necessary to prevent the laser beam exiting the irradiation site from interacting with the optics downstream of the light source, e.g., the illuminator/projection optics.

With the above in mind, Applicants disclose a source material collection unit for a laser produced plasma EUV light source and corresponding methods of use.

SUMMARY

In a first aspect, an EUV light source is disclosed which may comprise a laser source generating a laser beam and a source material, e.g., tin, $SnBr_4$, $SnBr_2$, $SnH_4$, tin-gallium alloys, tin-indium alloys, tin-indium-gallium alloys, or combinations thereof, that is irradiated by the laser beam to form a plasma and emit EUV light. For this aspect, the EUV light source may also comprise a beam dump positioned to receive the laser beam and a system controlling the temperature of the beam dump within a pre-selected range. In one embodiment, the source material may be irradiated at an irradiation zone and the source may further comprise a receiving structure formed with a surface that is shaped to receive source material ejected from the irradiation zone and direct the received source material for subsequent collection. The receiving structure and the beam dump may be formed as a single integrated unit and the receiving surface may, in some cases, comprise a conical shaped portion.

In a particular embodiment, the EUV light source may further comprise a collector mirror for directing the EUV light that is formed with an aperture to allow the laser beam to pass through the aperture to an irradiation site. For this embodiment, the aperture may establish a shadow volume devoid of EUV light reflected by the collector mirror, and portions or all of the beam dump and/or receiving structure may be positioned in the shadow volume. The EUV light source may, in some embodiments, comprise a droplet generator system for creating droplets of source material, e.g., a droplet stream. In one arrangement, the system may be capable of cooling the beam dump and in another particular arrangement, the system may be capable of heating and cooling the receiving structure. The EUV light source may further comprise a source material collection unit and the surface of the receiving structure may create a stream, e.g., continuous and/or droplets that is directed toward the collection unit. In one setup, the EUV light source may also include a collection unit to accumulate source material having a collection chamber that is formed with an orifice, an the orifice may be selectively positioned to pass source material from an EUV light source plasma chamber into the collection chamber. A cooling system may be provided to cool accumulated material in the collection chamber.

In another aspect of an embodiment of the invention, an EUV light source is disclosed which may comprise a laser source generating a laser beam, a source material irradiated by the laser beam at an irradiation zone to form a plasma and emit EUV light, and a receiving structure formed with a surface shaped to receive source material ejected from the irradiation zone and direct the received source material for subsequent collection. For this aspect, the light source may further comprise a system controlling the temperature of the receiving structure within a pre-selected range. In one implementation, the light source may further comprise a beam dump positioned to receive the laser beam, and in one particular implementation, the receiving structure and the beam dump may be formed as a single integrated unit. In an embodiment particularly suitable for volatile source materials, the receiving structure may comprise a chamber formed with an opening to allow source material ejected from the irradiation zone to enter the chamber.

In a particular aspect of an embodiment of the invention, a collection unit for accumulating source material from a EUV light source is disclosed which may include a collection chamber formed with an orifice, the orifice positioned to pass source material from an EUV light source plasma chamber into the collection chamber, and a cooling system for cooling material accumulated in the collection chamber. For this aspect, the collection unit may further comprise a pump for removing vapor from a headspace in the collection chamber. The source material may be volatile, e.g., $SnBr_4$ liquid. In one arrangement, the collection unit may further comprise a funnel positioned to direct source material into the orifice, and in a particular implementation, a heater may be provided heating the funnel above a melting temperature of the source material.

DETAILED DESCRIPTION OF PREFERRED EMBODIMENTS

Figure 1:
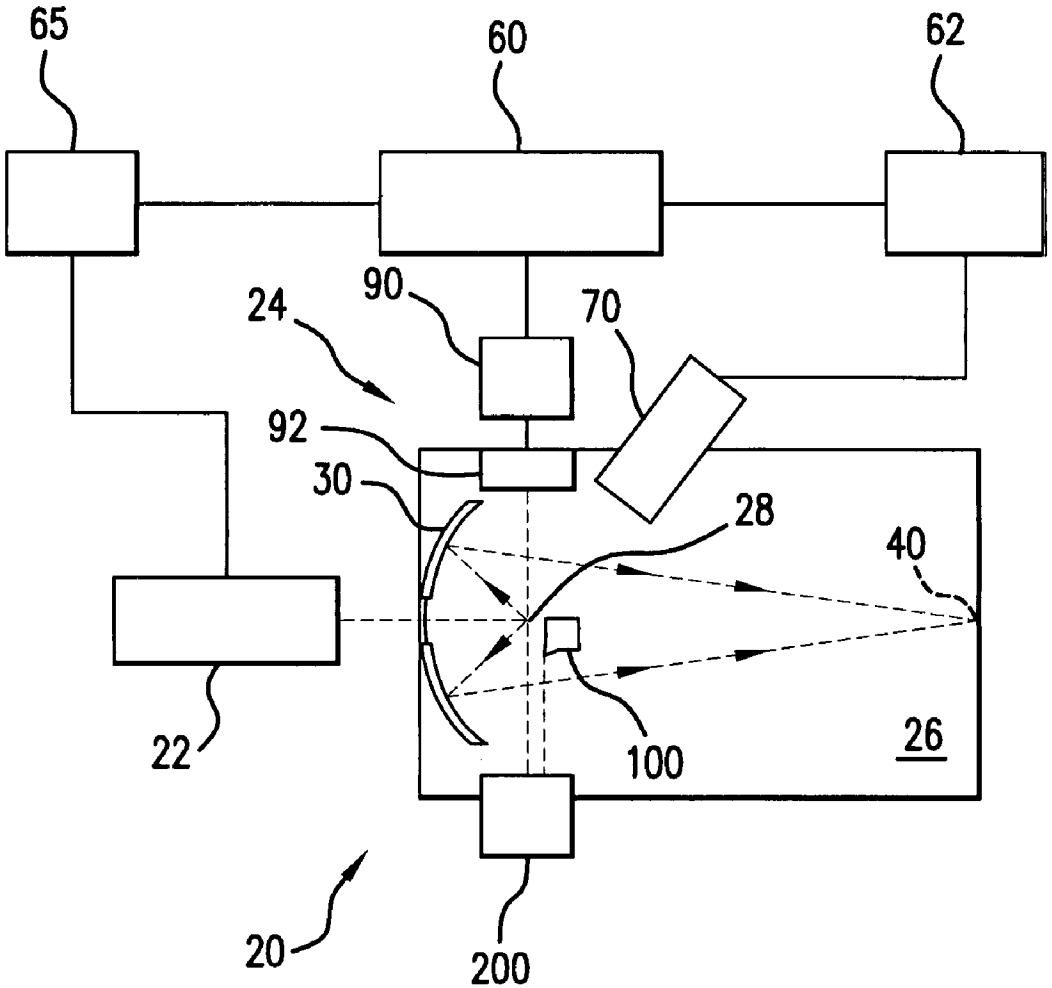
FIG. 1 shows a schematic, not to scale, view of an overall broad conception for a laser-produced plasma EUV light source according to an aspect of the present invention.

With initial reference to FIG. 1 there is shown a schematic view of an EUV light source, e.g., a laser produced plasma EUV light source 20 according to one aspect of an embodiment of the present invention. As shown, the LPP light source 20 may include a pulsed laser source 22, e.g., a pulsed gas discharge $CO_2$ laser source producing radiation at 10.6 μm, e.g., with DC or RF excitation operating at relatively high power and high pulse repetition rate. For example, a suitable $CO_2$ laser source having a MO-PA1-PA2-PA3 configuration is disclosed in co-pending U.S. patent application Ser. No. 11/174,299 filed on Jun. 29, 2005, and entitled, LPP EUV LIGHT SOURCE DRIVE LASER SYSTEM, the entire contents of which are hereby incorporated by reference herein.

Depending on the application, other types of lasers may also be suitable. For example, a solid state laser, an excimer, a molecular fluorine laser, a MOPA configured excimer laser system, e.g., as shown in U.S. Pat. Nos. 6,625,191, 6,549,551, and 6,567,450, an excimer laser having a single chamber, an excimer laser having two or more chambers, e.g., an oscillator chamber and two amplifying chambers (with the amplifying chambers in parallel or in series), a master oscillator/power oscillator (MOPO) arrangement, a power oscillator/power amplifier (POPA) arrangement, or a laser that seeds one or more $CO_2$, excimer or molecular fluorine amplifier or oscillator chambers, may be suitable. Other designs are possible.

The light source 20 may also include a target delivery system 24, e.g., delivering target(s), e.g., target(s) of a source material, e.g., a material containing a element, e.g., xenon, lithium or tin, indium, antimony, tellurium, aluminum, etc., with an emission line in the EUV spectrum. For example, the element tin may be used as pure tin, as a tin compound, e.g., $SnBr_4$, $SnBr_2$, $SnH_4$, as a tin alloy, e.g. tin-gallium alloys, tin-indium alloys, tin-indium-gallium alloys, or a combination thereof. Depending on the material used, the source material may be presented to the irradiation site at various temperatures including room temperature or near room temperature (e.g., tin alloys, $SnBr_4$) at an elevated temperature, (e.g., pure tin) or at temperatures below room temperature, (e.g., $SnH_4$) and can be relatively volatile, e.g., $SnBr_4$. More details concerning the use of these materials in an LPP EUV source is provided in co-pending U.S. patent application Ser. No. 11/406,216 filed on Apr. 17, 2006 entitled ALTERNATIVE FUELS FOR EUV LIGHT SOURCE, the contents of which has been previously incorporated by reference herein.

FIG. 1 shows that the target(s) may be delivered by a target delivery system 24, e.g., into the interior of a sealed vacuum chamber 26 to an irradiation site 28 where the target will be irradiated and produce a plasma. As shown, the light source 20 may also include one or more optical elements such as a collector mirror 30, e.g., a normal incidence reflector, e.g., a SiC substrate coated with a Mo/Si multilayer with additional thin barrier layers deposited at each interface to effectively block thermally-induced interlayer diffusion, in the form of a prolate ellipsoid, with an aperture to allow the laser light to pass through and reach the irradiation site 28. The collector 30 may be, e.g., in the shape of a ellipsoid that has a first focus at the irradiation site 28 and a second focus at a so-called intermediate point 40 (also called the intermediate focus 40) where the EUV light may be output from the light source 20 and input to, e.g., an integrated circuit lithography tool (not shown).

Continuing with FIG. 1, the light source 20 may also include an EUV light source controller system 60, which may also include a laser firing control system 65, along with, e.g., a laser beam positioning system (not shown). The light source 20 may also include a target position detection system which may include one or more droplet imagers 70 that provide an output indicative of the position of a target droplet, e.g., relative to the irradiation site 28 and provide this output to a target position detection feedback system 62, which can, e.g., compute a target position and trajectory, from which a target error can be computed, e.g., on a droplet by droplet basis or on average. The target error may then be provided as an input to the light source controller 60, which can, e.g., provide a laser position, direction and timing correction signal, e.g., to a laser beam positioning controller (not shown) that the laser beam positioning system can use, e.g., to control the laser timing circuit and/or to control a laser beam position and shaping system (not shown), e.g., to change the location and/or focal power of the laser beam focal spot within the chamber 26.

FIG. 1 also illustrates that the light source 20 may include a target delivery control system 90, operable in response to a signal (which in some implementations may include the target error described above, or some quantity derived therefrom) from the system controller 60, to e.g., modify the release point of the target droplets as released by the target delivery mechanism 92 to correct for errors in the target droplets arriving at the desired irradiation site 28. The light source 20 may also include a laser beam dump 100 and a source material collection unit 200.

Figure 2:
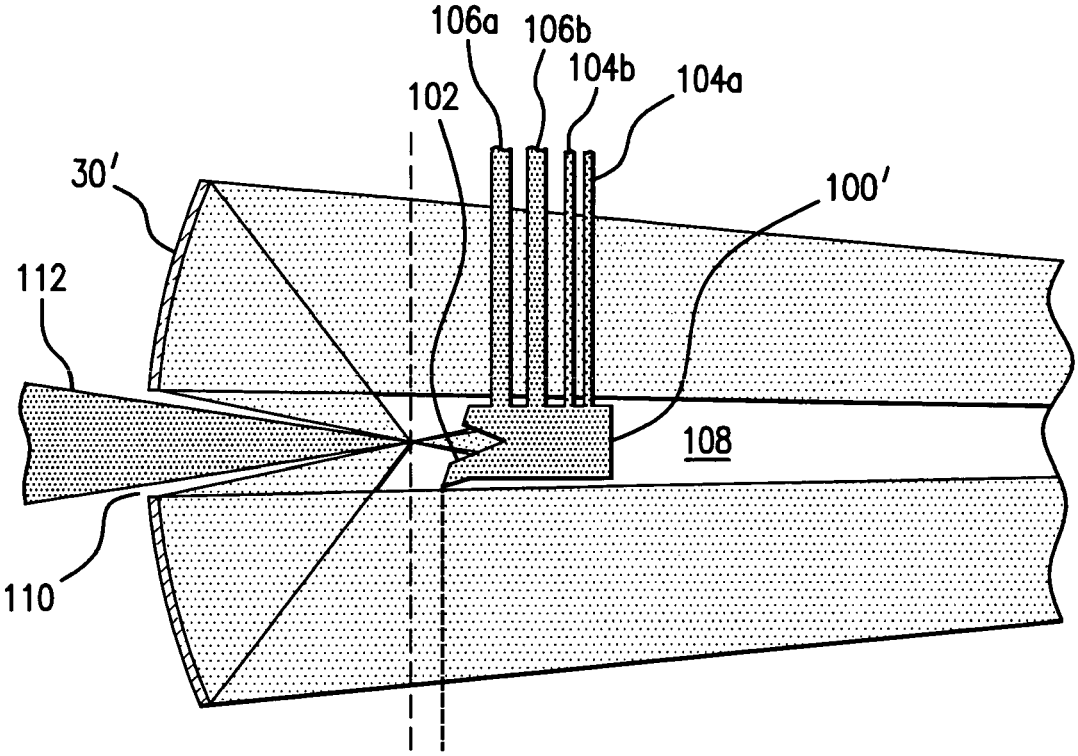
FIG. 2 shows a schematic, not to scale, cross-section view of portions of an LPP EUV light source having a collector mirror which establishes a shadow volume substantially devoid of EUV light and a beam dump/receiving structure positioned in the shadow volume.

FIG. 2 shows in greater detail a beam dump 100'. As shown, the beam dump 100' may be formed with a receiving structure formed with a surface 102 that is positioned to receive source material ejected from the irradiation zone. As indicated above, in some cases, after irradiation, a significant portion of the irradiated source material may be directed in the same general direction as the laser beam. Moreover, as shown, the surface may be used to selectively direct the received source material for subsequent collection. In particular, the surface 102 may be formed such that most or all of the source material leaves the surface as a single stream (continuous or droplets). In this manner, obstruction of the EUV light may be minimized and the exiting material stream can be placed along a selected path and may be directed to a collection unit 200 (see FIG. 1). For example, the surface 102 may include a conical surface portion which funnels source material to a release point located above the collection unit. The conically shaped wall may also reduce undesirable reflections of the laser beam.

FIG. 2 also illustrates that the beam dump 100' may include a system controlling the temperature of the beam dump 100' within a pre-selected range. In particular, tubes 104*a,b* may be used to pass a heat exchange fluid, e.g., coolant through the beam dump 100' to cool the beam dump 100' and tubes 106*a,b* may be used to pass an exchange fluid, through the beam dump 100' to heat the beam dump 100'. Alternatively, one of the tubes may be used as a conduit for wires to pass current to an electrical heater (not shown). Temperature control may be utilized to ensure that the source material remains molten and/or in a viscous state, to remove heat from the beam dump caused by source material and/or photons from the high energy laser beam and/or both. For example, during startup, before the laser beam heats the beam dump, the temperature control system may heat the beam dump to ensure the source material on the surface 102 is molten. Later, as the laser beam heats the beam dump, the temperature control system may extract heat from the beam dump 100' to ensure the beam dump 100' does not overheat. For example, a temperature sensor (not shown) in the beam dump may be used to control the temperature control system.

FIG. 2 also illustrates that the beam dump 100' may be positioned in a shadow volume 108. In more detail, for the embodiment shown, the EUV light source may include a collector mirror 30' for directing EUV light to e.g., an intermediate focus 40 (FIG. 1). For the light source shown in FIG. 2, the collector mirror 30' may be formed with an aperture 110 to allow the laser beam 112 to pass through the aperture 110 to the irradiation site. As shown, the aperture 110 may establish a shadow volume 108 devoid of EUV light reflected by the collector mirror 30', and portions or all of the beam dump and/or receiving structure may be positioned in the shadow volume 108 so as to minimize blocking of EUV light by the beam dump.

As shown in FIG. 1, source material from the beam dump 100 may be collected by a collection unit 200, which, in the simplest embodiments may be a catch basin. FIG. 1 also illustrates that non-irradiated droplets may also be collected by the collection unit 200. Note: in some implementations, only some droplets, e.g., every third or every fifth, allowing the non-irradiated droplets to block the next to-be irradiated droplet from the plasma.

Figure 3:
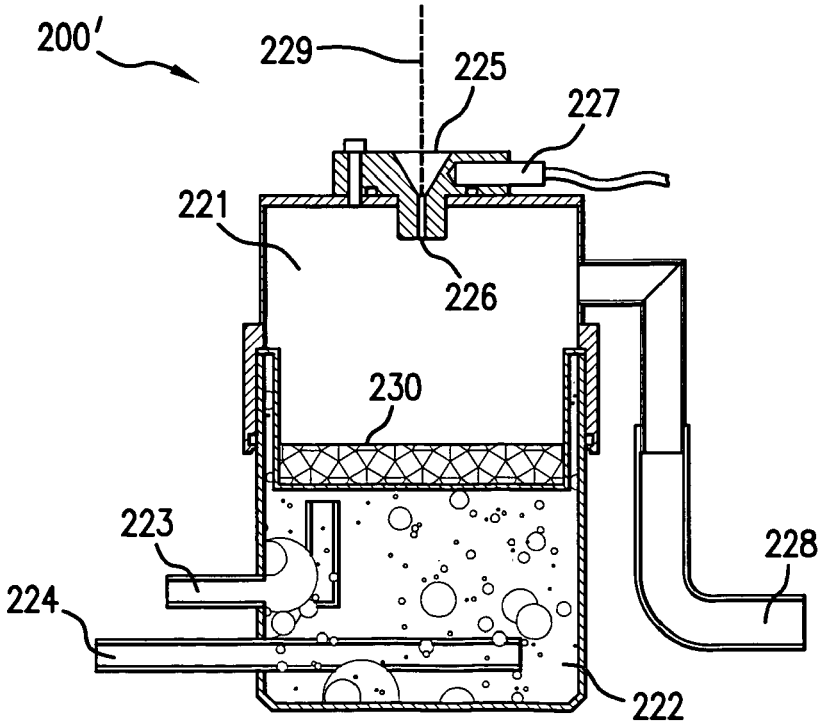
FIG. 3 shows a schematic, not to scale, cross-section view of a collector unit suitable for collecting volatile source material.

FIG. 3 shows an embodiment of a collection unit 200' suitable for use with a volatile source material such as $SnBr_4$ which has a vapor pressure of about 1 torr at 20 degrees C. As previously disclosed in co-pending U.S. patent application Ser. No. 11/406,216 entitled ALTERNATIVE FUELS FOR EUV LIGHT SOURCE, filed on Apr. 17, 2006, an EUV source may operate with Sn-containing compounds such as $SnBr_4$ at a relatively low operating temperature (melting temperature of $SnBr_4$ is as low as 31 degree C.) with the $SnBr_4$ being a source of Bromide when $SnBr_4$ is decomposed in the plasma. The Bromide which may be useful etching deposited Sn debris from the EUV light source optics such as the collector mirror. On the other hand, the vapor of $SnBr_4$ absorbs EUV radiation and does not assist in etching the Sn from the collector. The vapor pressure of a volatile target material, (e.g., $SnBr_4$) can be significant if the surface area of evaporation in the vacuum chamber is large.

The source material collection unit 200' shown in FIG. 3 may be configured to minimize the surface area of the target material interfacing with the vacuum chamber of the EUV source. As shown, droplets 229, which may be source material from a beam dump and/or non-irradiated droplets may be collected by one or more funnels 225, each having a relatively small orifice 226 providing material flow to collection chamber 221. The collected material 230 may be cooled, e.g., by water, liquid N2 or another freezing agent 222 supplied through the pipes 223, 224 (exhaust and supply, respectively). As further shown, the funnel 225 may be heated by heater 227 to maintain the temperature of the funnel 225 about the melting temperature of the source material (e.g., above 31 deg. C. for $SnBr_4$). The collection chamber 221 may be differentially pumped through pipe 228. Typically, the cross section area of the pipe may be sized larger than the cross section area of orifice 226. For example, the diameter of the orifice 226 may be about 2-3 mm and the diameter of the differential pumping pipe 228 may be about 12-15 mm. In some implementations, the accumulated material 230 may be maintained at temperature above its melting point to allow for easy removal from the collection chamber.

Figure 4:
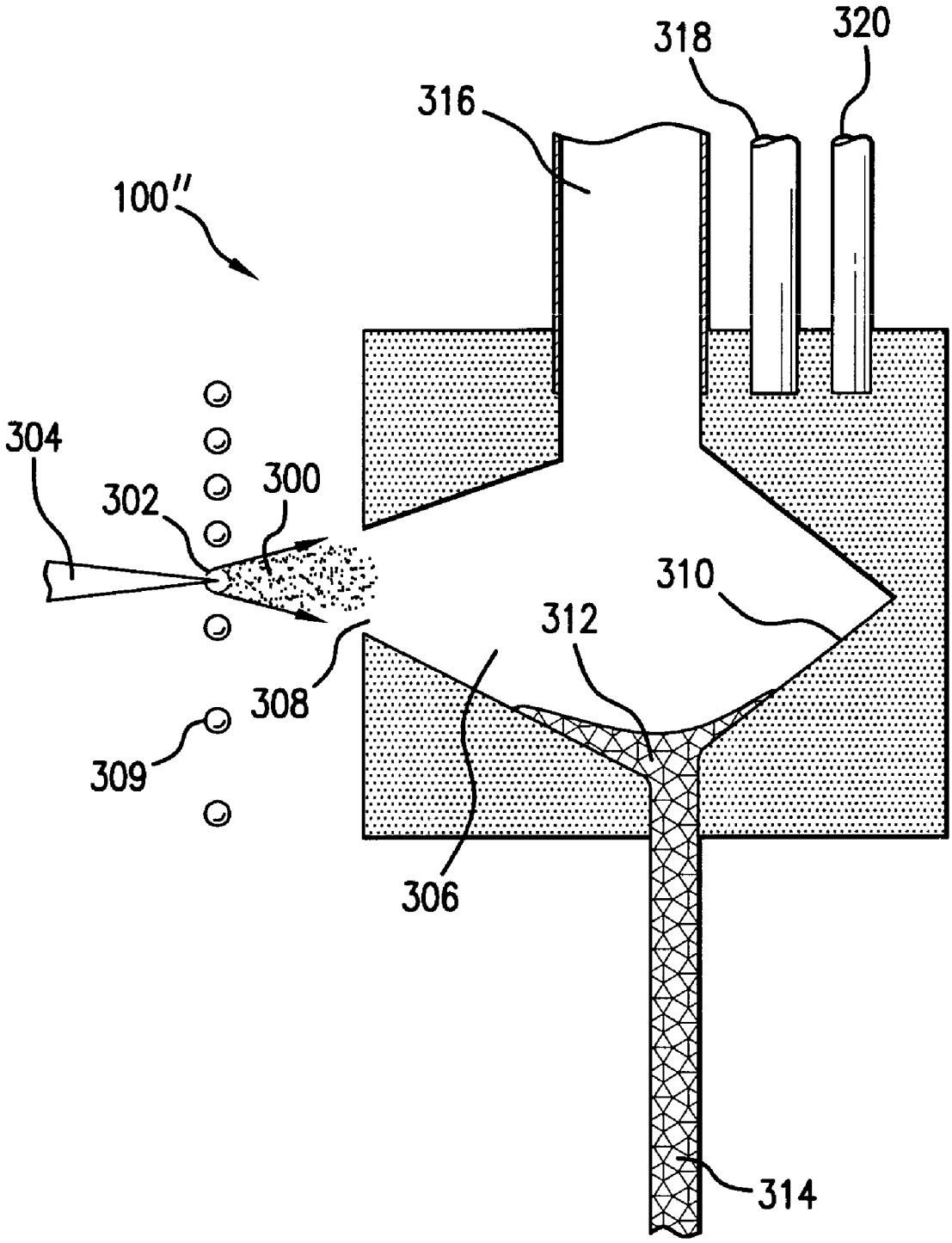
FIG. 4 shows another embodiment of a beam dump/receiving structure that is particularly suitable for use with a volatile source material such as $SnBr_4$.

FIG. 4 shows another embodiment of a beam dump 100" having a receiving structure for receiving source material 300 that is ejected from an irradiation site 302 upon illumination of source material, e.g., droplet by a laser beam 304. Portions or all of the beam dump 100" may be positioned in the shadow volume established by a laser input window (see FIG. 2 and corresponding description) to minimize obstruction of EUV light exiting the light source. As shown, the beam dump 100" may include a receiving structure which surrounds a chamber 306 and is formed with an opening 308 to allow ejected source material 300 to enter the chamber 306 and be collected therein. Non-irradiated droplets, e.g., droplet 309, may be collected, for example, using the collection unit 200' shown in FIG. 3.

As shown in FIG. 4, after interaction with the laser beam 304, the source material 300 typically breaks up into a number of small droplets and moves along the direction of laser beam 304. The source material may be collected for subsequent use/recycle and/or to minimize exposure of the material to the vacuum chamber, (especially when a volatile source material, e.g., $SnBr_4$ is used) where the material may adversely coat optics and/or absorb EUV light. Typically, the input opening 308 is sized large enough and positioned relative to the irradiation site to allow substantially all of the expanding droplet target to enter the chamber 306.

FIG. 4 further shows that the chamber may be formed with a sloping and/or conically shaped wall 310 to direct, e.g., funnel, collected source material 312 to a drain pipe 314, which in turn, may transport the material 312 out of the vacuum chamber, e.g., via gravity or pumping. The conically shaped wall 310 may also reduce undesirable reflections of the laser beam 304. The headspace in chamber 306 may be differentially pumped via pipe 316 to further remove vapors which may reenter the vacuum chamber and absorb EUV radiation.

For the beam dump 100", the temperature of the chamber 306 and walls may be maintained by elements 318, 320, which may include, e.g., heating/cooling fluid pipes or/and wire conduits to pass electric current to an electrical heater. For example, the temperature may be maintained close to the melting temperature of the source material, e.g. 31-35 deg C. for $SnBr_4$. At this temperature, the viscosity of the material may be low enough to allow for efficient transportation of the material to a recycling system. On the other hand, maintaining the collected material at a relative low temperature results in a relatively low vapor pressure, which in turn reduces the amount of source material which may escape the chamber 306 and adversely affect optics/absorb EUV light.

It will be understood by those skilled in the art that aspects of embodiments of the subject matter disclosed above are intended to satisfy the requirement of disclosing at least one enabling embodiment of the subject matter of each claim and to be one or more such exemplary embodiments only and to not to limit the scope of any of the claims in any way and particularly not to a specific disclosed embodiment alone. Many changes and modification can be made to the disclosed aspects of embodiments of the disclosed subject matter of the claims that will be understood and appreciated by those skilled in the art, particularly in regard to interpretation of the claims for purposes of the doctrine of equivalents. The appended claims are intended in scope and meaning to cover not only the disclosed aspects of embodiments of the claimed subject matter but also such equivalents and other modifications and changes that would be apparent to those skilled in the art. In additions to changes and modifications to the disclosed and claimed aspects of the subject matter disclosed of the present invention(s) noted above, others could be implemented. While the particular aspects of embodiment(s) of the SOURCE MATERIAL COLLECTION UNIT FOR A LASER PRODUCED PLASMA EUV LIGHT SOURCE described and illustrated in this patent application in the detail required to satisfy 35 U.S.C. §112 is fully capable of attaining any above-described purposes for, problems to be solved by or any other reasons for or objects of the aspects of an embodiment(s) above described, it is to be understood by those skilled in the art that it is the presently described aspects of the described embodiment(s) of the subject matter claimed are merely exemplary, illustrative and representative of the subject matter which is broadly contemplated by the claimed subject matter. The scope of the presently described and claimed aspects of embodiments fully encompasses other embodiments which may now be or may become obvious to those skilled in the art based on the teachings of the Specification. The scope of the present SOURCE MATERIAL COLLECTION UNIT FOR A LASER PRODUCED PLASMA EUV LIGHT SOURCE is solely and completely limited by only the appended claims and nothing beyond the recitations of the appended claims. Reference to an element in such claims in the singular is not intended to mean nor shall it mean in interpreting such claim element "one and only one" unless explicitly so stated, but rather "one or more". All structural and functional equivalents to any of the elements of the above-described aspects of an embodiment(s) that are known or later come to be known to those of ordinary skill in the art are expressly incorporated herein by reference and are intended to be encompassed by the present claims. Any term used in the Specification and/or in the claims and expressly given a meaning in the Specification and/or claims in the present application shall have that meaning, regardless of any dictionary or other commonly used meaning for such a term. It is not intended or necessary for a device or method discussed in the Specification as any aspect of an embodiment to address each and every problem sought to be solved by the aspects of embodiments disclosed in this application, for it to be encompassed by the present claims. No element, component, or method step in the present disclosure is intended to be dedicated to the public regardless of whether the element, component, or method step is explicitly recited in the claims. No claim element in the appended claims is to be construed under the provisions of 35 U.S.C. §112, sixth paragraph, unless the element is expressly recited using the phrase "means for" or, in the case of a method claim, the element is recited as a "step" instead of an "act."

It will be understood also be those skilled in the art that, in fulfillment of the patent statutes of the United States, applicant(s) has disclosed at least one enabling and working embodiment of each invention recited in any respective claim appended to the Specification in the present application and perhaps in some cases only one. For purposes of cutting down on patent application length and drafting time and making the present patent application more readable to the inventor(s) and others, applicant(s) has used from time to time or throughout the present application definitive verbs (e.g., "is", "are", "does", "has", "includes" or the like) and/or other definitive verbs (e.g., "produces," "causes" "samples," "reads," "signals" or the like) and/or gerunds (e.g., "producing," "using," "taking," "keeping," "making," "determining," "measuring," "calculating" or the like), in defining an aspect/feature/element of, an action of or functionality of, and/or describing any other definition of an aspect/feature/element of an embodiment of the subject matter being disclosed. Wherever any such definitive word or phrase or the like is used to describe an aspect/feature/element of any of the one or more embodiments disclosed herein, i.e., any feature, element, system, sub-system, component, sub-component, process or algorithm step, particular material, or the like, it should be read, for purposes of interpreting the scope of the subject matter of what applicant(s) has invented, and claimed, to be preceded by one or more, or all, of the following limiting phrases, "by way of example," "for example," "as an example," "illustratively only," "by way of illustration only," etc., and/or to include any one or more, or all, of the phrases "may be," "can be", "might be," "could be" and the like. All such features, elements, steps, materials and the like should be considered to be described only as a possible aspect of the one or more disclosed embodiments and not as the sole possible implementation of any one or more aspects/features/elements of any embodiments and/or the sole possible embodiment of the subject matter of what is claimed, even if, in fulfillment of the requirements of the patent statutes, applicant(s) has disclosed only a single enabling example of any such aspect/feature/element of an embodiment or of any embodiment of the subject matter of what is claimed. Unless expressly and specifically so stated in the present application or the prosecution of this application, that applicant(s) believes that a particular aspect/feature/element of any disclosed embodiment or any particular disclosed embodiment of the subject matter of what is claimed, amounts to the one an only way to implement the subject matter of what is claimed or any aspect/feature/element recited in any such claim, applicant(s) does not intend that any description of any disclosed aspect/feature/element of any disclosed embodiment of the subject matter of what is claimed in the present patent application or the entire embodiment shall be interpreted to be such one and only way to implement the subject matter of what is claimed or any aspect/feature/element thereof, and to thus limit any claim which is broad enough to cover any such disclosed implementation along with other possible implementations of the subject matter of what is claimed, to such disclosed aspect/feature/element of such disclosed embodiment or such disclosed embodiment. Applicant(s) specifically, expressly and unequivocally intends that any claim that has depending from it a dependent claim with any further detail of any aspect/feature/element, step, or the like of the subject matter of what is claimed recited in the parent claim or claims from which it directly or indirectly depends, shall be interpreted to mean that the recitation in the parent claim(s) was broad enough to cover the further detail in the dependent claim along with other implementations and that the further detail was not the only way to implement the aspect/feature/element claimed in any such parent claim(s), and thus be limited to the further detail of any such aspect/feature/element recited in any such dependent claim to in any way limit the scope of the broader aspect/feature/element of any such parent claim, including by incorporating the further detail of the dependent claim into the parent claim.

We claim:

1. An EUV light source, said source comprising:

a laser source generating a laser beam;

a source material irradiated by said laser beam to form a plasma and emit EUV light;

a beam dump positioned to receive the laser beam; and a system controlling the temperature of the beam dump within a pre-selected range.

2. A light source as recited in claim 1 wherein said source material is irradiated at an irradiation zone and said source further comprises a receiving structure formed with a surface shaped to receive source material ejected from the irradiation zone and direct the received source material for subsequent collection.

3. A light source as recited in claim 2 wherein said receiving structure and said beam dump are formed as a single integrated unit.

4. A light source as recited in claim 2 wherein said surface of said receiving structure comprises a conical shaped portion.

5. A light source as recited in claim 2 wherein said source further comprises a collector mirror directing said EUV light, said collector mirror formed with an aperture allowing said laser beam to pass through, said aperture establishing a shadow volume devoid of EUV light reflected by said collector mirror, and wherein said structure is positioned in said shadow volume.

6. An EUV light source as recited in claim 2 wherein said system is capable of heating and cooling said receiving structure.

7. An EUV light source as recited in claim 2 wherein said source further comprises a source material collection unit and wherein said surface of said receiving structure creates a stream of droplets directed toward said collection unit.

8. A light source as recited in claim 1 wherein said source further comprises a collector mirror directing said EUV light, said collector mirror formed with an aperture allowing said laser beam to pass through, said aperture establishing a shadow volume devoid of EUV light reflected by said collector mirror, and wherein said beam dump is positioned in said shadow volume.

9. A light source as recited in claim 1 wherein said source material is selected from the group of materials consisting of tin, $SnBr_4$, $SnBr_2$, $SnH_4$, tin-gallium alloys, tin-indium alloys, tin-indium-gallium alloys and combinations thereof.

10. An EUV light source as recited in claim 1 further comprising a droplet generator system for creating droplets of source material.

11. An EUV light source as recited in claim 1 wherein said system is capable of cooling said beam dump.

12. A light source as recited in claim 1 further comprising a collection unit accumulating source material said collection unit comprising:

a collection chamber formed with a narrow opening, said opening positioned to pass source material from an EUV light source plasma chamber into the collection chamber; and a cooling system cooling material accumulated in said collection chamber.

13. An EUV light source, said source comprising:

a laser source generating a laser beam;

a source material irradiated by said laser beam at an irradiation zone to form a plasma and emit EUV light;

a receiving structure formed with a surface shaped to receive source material ejected from the irradiation zone and direct the received source material for subsequent collection; and a beam dump positioned to receive the laser beam.

14. A light source as recited in claim 13 further comprising a system controlling the temperature of the receiving structure within a pre-selected range.

15. A light source as recited in claim 13 wherein said receiving structure and said beam dump are formed as a single integrated unit.

16. A light source as recited in claim 13 wherein said surface of said receiving structure comprises a conical shaped portion.

17. A light source as recited in claim 13 wherein said source material is selected from the group of materials consisting of tin, $SnBr_4$, $SnBr_2$, $SnH_4$, tin-gallium alloys, tin-indium alloys, tin-indium-gallium alloys and combinations thereof.

18. A light source as recited in claim 13 further comprising a collection unit accumulating source material, said collection unit comprising:

a collection chamber formed with an orifice, said orifice positioned to pass source material from an FUV light source plasma chamber into the collection chamber; and a cooling system cooling material accumulated in said collection chamber.

19. A light source as recited in claim 13 wherein said receiving structure comprises a chamber formed with an opening to allow source material ejected from the irradiation zone to enter the chamber.

20. An EUV light source, said source comprising:

a laser source generating a laser beam;

a source material irradiated by said laser beam at an irradiation zone to form a plasma and emit EUV light;

a receiving structure formed with a surface shaped to receive source material ejected from the irradiation zone and direct the received source material for subsequent collection; and wherein said source further comprises a collector mirror directing said EUV light, said collector mirror formed with an aperture allowing said laser beam to pass through, said aperture establishing a shadow volume substantially devoid of EUV light reflected by said collector mirror, and wherein said receiving structure is positioned in said shadow volume.

21. A light source as recited in claim 20 further comprising a beam dump positioned to receive the laser beam.

22. A collection unit for accumulating source material from a EUV light source, said collection unit comprising:

a collection chamber formed with an orifice, said orifice positioned to pass source material from an EUV light source plasma chamber into the collection chamber; and a cooling system cooling material accumulated in said collection chamber and maintaining at least a portion of said accumulated material in a liquid state.

23. A collection unit as recited in claim 22 further comprising a pump for removing vapor from a headspace in said collection chamber.

24. A collection unit as recited in claim 22 further comprising a funnel positioned to direct source material into said orifice.

25. A collection unit as recited in claim 24 further comprising a heater heating said funnel above a melting temperature of said source material.

26. A collection unit as recited in claim 22 wherein said source material comprises $SnBr_4$ liquid.

* * * * *